US005548313A

United States Patent [19]

Lee

[11] Patent Number: 5,548,313

[45] Date of Patent: Aug. 20, 1996

[54] INKJET PRINTING HEAD

[75] Inventor: Ki-bang Lee, Seoul, Rep. of Korea

[73] Assignee: Samsung Electronics Co., Ltd., Kyungki-do, Rep. of Korea

[21] Appl. No.: 169,400

[22] Filed: Dec. 20, 1993

[30] Foreign Application Priority Data

May 31, 1993 [KR] Rep. of Korea ..... 93-9737

[51] Int. Cl.[6] ..... B41J 2/045

[52] U.S. Cl. ..... 347/68

[58] Field of Search ..... 347/69, 71, 68; 310/328, 333

[56] References Cited

U.S. PATENT DOCUMENTS 3,946,398 3/1976 Kyser et al. ..... 346/1

4,584,590 4/1986 Fischbeck et al. ..... 346/140 R 4,879,568 11/1989 Bartky et al. ..... 346/140 R 4,887,100 12/1989 Michaelis et al. ..... 347/69

*Primary Examiner*—Benjamin R. Fuller

*Assistant Examiner*—Alrick Bobb

*Attorney, Agent, or Firm*—Leydig, Voit & Mayer

[57] ABSTRACT

Inkjet printing head utilizing a shear mode and, simultaneously, tension and compression modes for effectively preventing damage to the contact interface of the piezoelectric device, includes at least one piezoelectric device installed on a pressure channel, having shear, tension and compression modes and combined with the upper and lower plates of the channel, the piezoelectric device having electrodes supplying an electrical field thereof.

19 Claims, 4 Drawing Sheets

INKJET PRINTING HEAD

BACKGROUND OF THE INVENTION

The present invention relates to an inkjet printing head, and more particularly to an inkjet printing head for ejecting the ink by means of piezoelectric devices.

Among non-impact printing methods, the inkjet printing method does not create a noise when printing, prints on normal sheets of paper, and does not require a special setting of the ink, and is therefore considered a method for simple printing accomplished by a simply structured apparatus. Therefore, in the recent years the inkjet printing method has been on the way to its most active development. In the case of this method, a printing head having an ejecting hole is provided for ejecting dyed liquid, to thereby propel droplets thereof. Here, an inlet hole for receiving the liquid is utilized.

Of such inkjet printing heads, the drop-on-demand type printing head for ejecting the ink only upon the signal input, has certain variations. Among these, a Kyser type printing head disclosed in U.S. Pat. No. 3,946,398, is one in that the ink channel is connected to the nozzle, and the piezoelectric device being combined with a bimetal is arranged on one side of the channel, so that the piezoelectric device deforms only when supplied with a voltage. Therefore, liquid ink is even more pressurized in the channel, to ultimately eject the ink through the nozzle. However, such a printing head shows a disadvantage in that the nozzle cannot be fabricated for high-integration due to the size of the piezoelectric device and thus the manufacturing cost rises.

Being different from the Kyser type printing head, the Fischbeck type printing head disclosed in U.S. Pat. No. 4,584,590 is one that utilizes a principle of shear deformation of the piezoelectric device in the electrical field. Here, the piezoelectric device constituting a wall of the channel deforms toward the channel, so that the ink within the channel is forced to be ejected through the nozzle. Such a printing head exhibits a disadvantage in that the nozzle cannot be used for high-integration due to its structural cause.

Another type of printing head, using a shear deformation, is the Bartky type disclosed in U.S. Pat. No. 4,879,568. In this type, the piezoelectric device is arranged parallel to the electrical field for its shear deformation, so that the printing density of the nozzle can be enhanced. However, such a printing head also provides a disadvantage in that the contact portion is easily disrupted due to the tension stress occurring on the contact portion by a deformation (mainly related to the piezoelectric constant) other than shear deformation generated since the manufacture the piezoelectric devices. Moreover, the above printing head has another disadvantage in that the contact portion is easily disrupted by a tension stress thereon, even if the piezoelectric device is combined with an electrode for mass production.

SUMMARY OF THE INVENTION

It is an object of the present invention to provide an inkjet printing head capable of being manufactured with ease and capable of a multi-nozzle formation for high-printing density.

It is another object of the present invention to provide an inkjet printing head which utilizes tensile and compressive deformations as well as the shear deformation so as to minimize the tension stress on the contact portion between the piezoelectric device and the supporting plate, and which therefore can be used for increasing the lifetime of the printing head.

To accomplish the above object, the present invention provides an inkjet printing head comprising upper and lower plates having a predetermined interval therebetween; a nozzle arranged on a wall connecting the upper plate with the lower plate for ejecting ink droplets; a channel connected to the nozzle for transmitting the pressure wave towards the nozzle so as to eject the ink droplets; at least one piezoelectric device installed on the channel, having shear, tensile and compressive modes, and attached to the upper and lower plates by its upper and lower parts; and a piezoelectric actuator having a composite mode of the shear, tensile and compressive modes and having an electrode for supplying an electrical field for the piezoelectric device.

BRIEF DESCRIPTION OF THE DRAWINGS

The above object and other advantages of the present invention will become more apparent by describing in detail a preferred embodiment of the present invention with reference to the attached drawings in which.

DETAILED DESCRIPTION OF THE INVENTION

Figure 1:
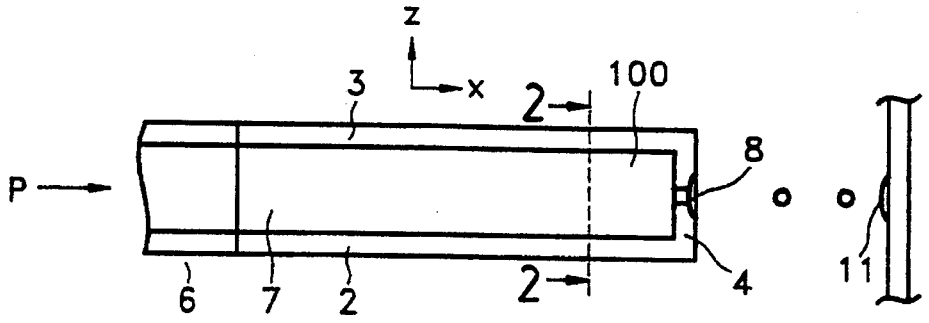
FIG. 1 is a schematic side view of an inkjet printing head according to the present invention.
Figure 2:
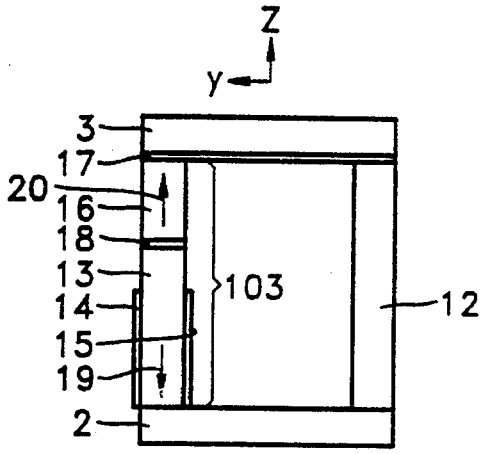
FIG. 2 is a sectional view along line 2—2 of FIG. 1.

Referring to FIGS. 1 and 2, an upper plate 3 and a lower plate 2 having a predetermined interval therebetween is interposed by a fixed wall 12 and an actuator 103, thereby a channel is formed between the upper and lower plates. The actuator is comprised of two plates, i.e., upper and lower piezoelectric devices 16 and 13, which are arranged longitudinally end to end. A second electrode 18 is interposed between two piezoelectric devices, and a lower piezoelectric device 13 is furnished with third and fourth electrodes 14 and 15 on its sides. A first electrode 17 is formed beneath upper plate 3, and the first electrode corresponds to the second electrode. Here, the upper and lower piezoelectric devices are polarized longitudinally, while their polarization directions are indicated by reference numerals 19 and 20 (FIG. 3).

Referring to FIG. 1, one side of the channel is connected with ink supplying means 6 for supplying ink for the channel with a predetermined pressure, and the other side thereof is furnished with a nozzle plate 4 having a nozzle for ejecting the ink. Here, reference numeral 8 indicates a meniscus caused by a surface tension of ink, and reference numeral 11 denotes an ink droplet attached to the paper.

Figure 3:
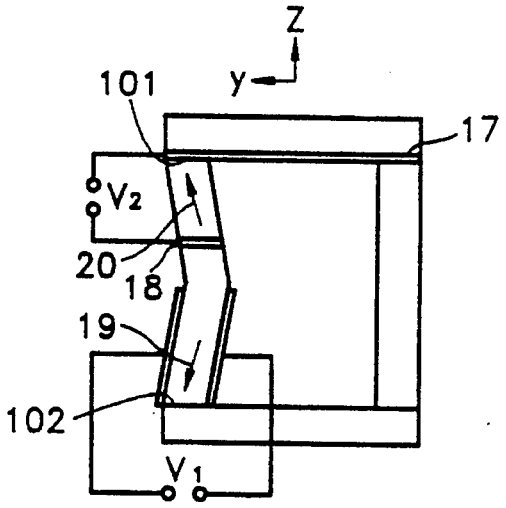
FIG. 3 illustrates operation of the printing head according to the present invention.

The operation of the printing head according to the present invention is described in reference to FIG. 3. When only third and fourth electrodes 14 and 15 are supplied with voltage $V_1$ without the application of voltage $V_2$ between the first and second electrodes 17 and 18, an electrical field is formed perpendicular to the polarization direction 19 of lower piezoelectric device 13. Therefore, lower piezoelectric device 13 deforms in the direction of the electrical field by means of the shear deformation thereof and, at this moment, a tensile stress is generated at contact portions 101 and 102.

To help remove the tensile stress, another electrical field is formed parallel to the polarization direction 19 by applying voltage $V_2$ between the upper and lower electrodes, first and second electrodes 17 and 18, of upper piezoelectric device 16 elongated parallel to its length. Therefore, the tensile stress at the contact portions 101 and 102 due to the deformation of lower piezoelectric device 13 is eradicated. Thus, the life of the overall head can be extended by means of the compensating operation of the upper piezoelectric device.

FIGS. 4 through 13 are schematic views of the printing head according to other embodiments of the present invention and views thereof while in operation. Here, the structure of the printing head is same as that of FIGS. 1 and 2 except for the piezoelectric actuator and the electrode.

Figure 4:
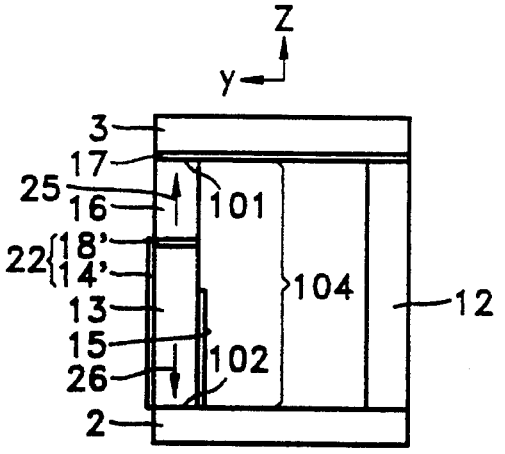
FIGS. 4 and 5 are a sectional view of the printing head according to another embodiment of the present invention and a sectional view illustrating the operation thereof, respectively.
Figure 5:
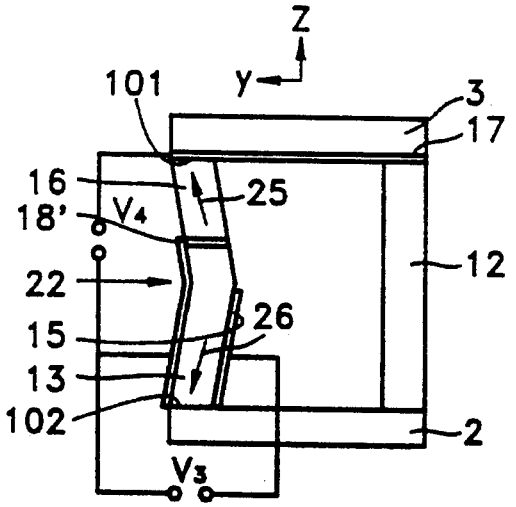

In accordance with an embodiment of the present invention shown in FIGS. 4 and 5, the second and third electrodes which are separately formed as shown in FIG. 2, are combined with each other so as to form a fifth electrode 22. Here, a piezoelectric actuator 104 comprises the upper and lower piezoelectric devices 16 and 13 having the polarization directions 25 and 26 (FIG. 5) along their lengths, respectively. A horizontal part 18' of fifth electrode 22 is interposed between piezoelectric devices 16 and 13, and a first electrode 17 is formed beneath upper plate 3. A fourth electrode 15 is formed on one side of lower piezoelectric device 13, which opposes to the vertical portion of fifth electrode 22.

FIG. 5 is a view showing the actuator in operation, which is constructed as shown in FIG. 4. When a voltage $V_3$ is applied between the fourth and fifth electrodes and a voltage $V_4$ is applied between the first and fifth electrodes, the operation of the actuator is same as in the aforementioned embodiment shown in FIGS. 1 through 3. That is, when voltage $V_4$ is not applied between first and fifth electrodes 17 and 22, but voltage $V_3$ is applied between fourth and fifth electrodes 15 and 22, an electrical field is formed vertical to the polarization direction 26 of lower piezoelectric device 13; and thereby a shear deformation deforms lower piezoelectric device 13 in the direction of electrical field as shown in FIG. 5.

At this time, a tensile stress is produced at contact portions 101 and 102. To help remove the tensile stress, a voltage $V_2$ is simultaneously applied between the upper and lower electrodes, first and fifth electrodes 17 and 22, of tipper piezoelectric device 16, and thereby an electrical field is formed in parallel to the polarization direction 25. Accordingly, the upper piezoelectric device is elongated lengthwise, so that the tensile stress at contact portions 101 and 102 due to the deformation of lower piezoelectric device 13 is canceled.

Figure 6:
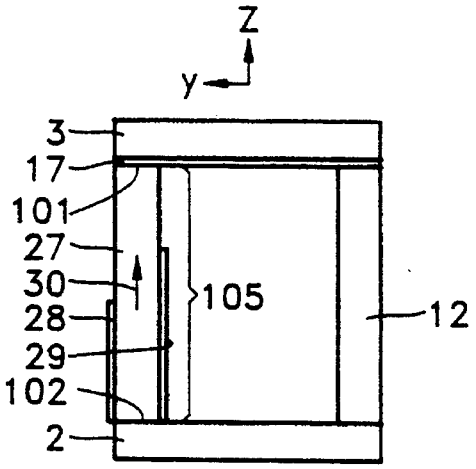
FIGS. 6 and 7 are a sectional view of the printing head according to still another embodiment of the present invention and a sectional view illustrating the operation thereof, respectively.

FIG. 6 illustrates the printing head according to the third embodiment of the present invention, which is more simply constructed by making the piezoelectric actuator using one piezoelectric device. The piezoelectric actuator is comprised of a piezoelectric device 27 which is polarized along the polarization direction 30 parallel to its length, and two electrodes 28 and 29 which are of different lengths and attached to either side of the piezoelectric device so as to oppose each other. The actuator is interposed between the upper and lower plates 3 and 2, as in the other embodiments.

Figure 7:
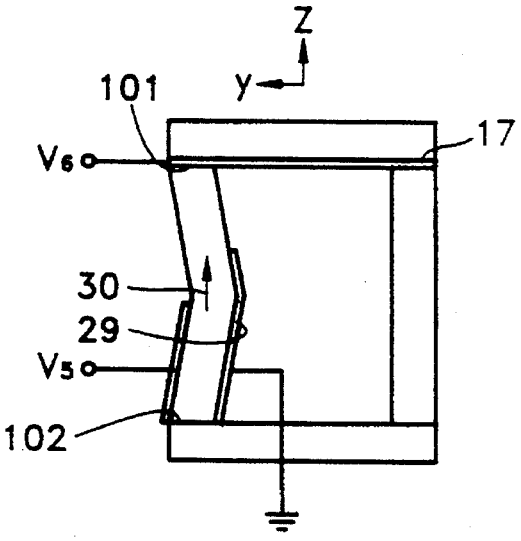

FIG. 7 shows the actuator of FIG. 6 in operation. Due to voltage $V_5$, piezoelectric device 27 deforms in a shear mode along the direction of the electrical field which is caused by voltage $V_5$. Due to voltage $V_6$, an electrical field is formed between long electrode 29 and upper electrode 17, so that a part of piezoelectric device 27 is elongated lengthwise and, thereby, the tensile stress on a contact portion between the upper and lower plates is reduced.

Figure 8:
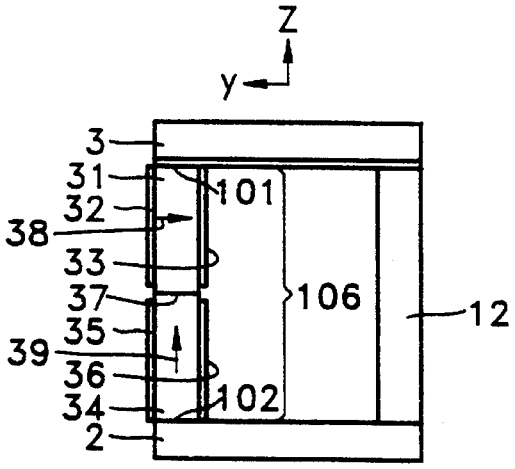
FIGS. 8 and 9 are a sectional view of the printing head according to yet another embodiment of the present invention and a sectional view illustrating the operation thereof, respectively.

FIG. 8 illustrates a fourth embodiment of the printing head according to the present invention. Here, piezoelectric actuator 106 is comprised of an tipper piezoelectric device 31 which is latitudinally polarized in the direction of polarization direction 38 and combined with a pair of upper electrodes 32 and 33 on either side thereof, and a lower piezoelectric device 34 which is longitudinally polarized in the polarization direction 39 and combined with a pair of lower electrodes 35 and 36 on either side thereof, while the upper and lower piezoelectric devices 31 and 34 are attached lengthwise end to end.

Figure 9:
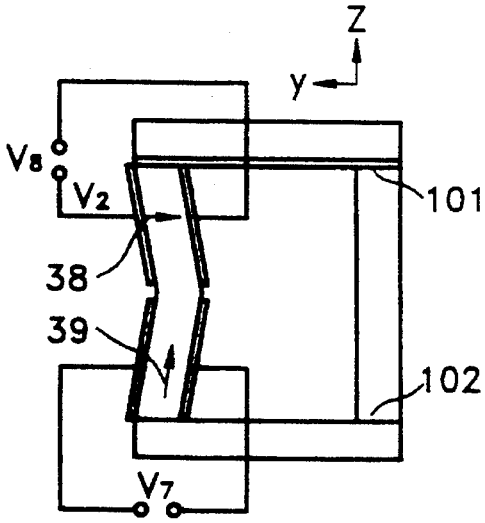

FIG. 9 illustrates an operation of the printing head according to the fourth embodiment of the present invention shown in FIG. 8. Here, the deformations in the longitudinal direction of the piezoelectric devices due to voltages $V_7$ and $V_8$ reduce the stresses on contact portions 101 and 102.

Figure 10:
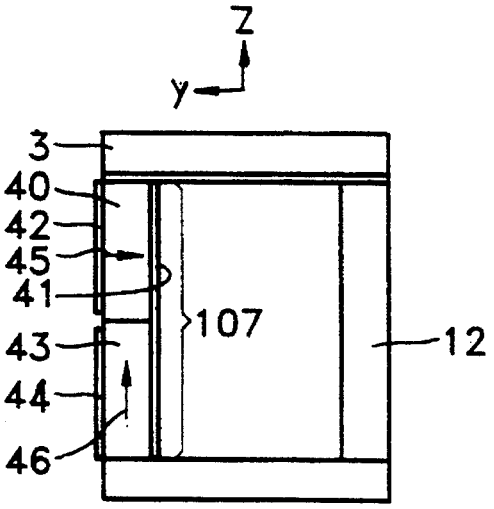
FIGS. 10 and 11 are a sectional view of the printing head according to still a further embodiment of the present invention and a sectional view illustrating the operation thereof, respectively.

FIG. 10 shows a fifth embodiment of the printing head according to the present invention, wherein actuator 107 is constructed such that the upper and lower electrodes in the above embodiment is combined on one side. The actuator is comprised of all upper piezoelectric device 40 which is latitudinally polarized in the direction 45 and a lower piezoelectric device 43 which is longitudinally polarized in the direction 46 and is positioned between the upper and lower plates 3 and 2, while the upper and lower piezoelectric devices are combined with each other end to end. The actuator is equipped with a common electrode 41 on one side thereof, and with electrodes 42 and 44 corresponding to upper and lower piezoelectric devices 40 and 43 on the upper and lower parts of the other side thereof.

Figure 11:
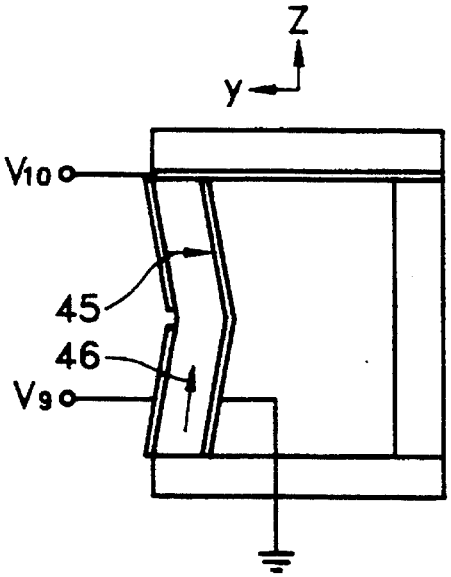

FIG. 11 illustrates an operation of the piezoelectric actuator according to the fifth embodiment of the printing head of the present invention, while the operational principle thereof is same as the fourth embodiment.

Figure 12:
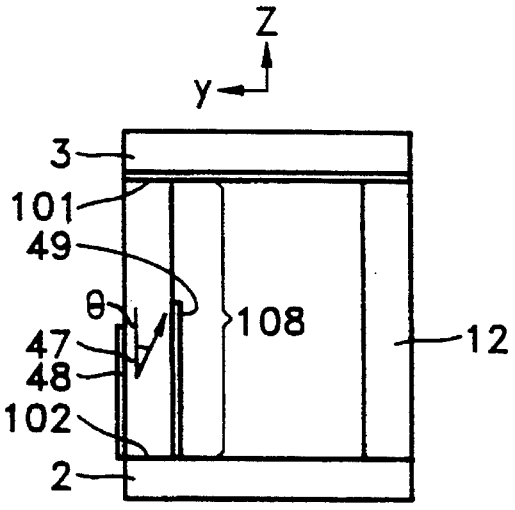
FIGS. 12 and 13 are a sectional view of the printing head according to yet another embodiment of the present invention and a sectional view illustrating the operation thereof, respectively.

FIG. 12 illustrates a sixth embodiment of the present invention, showing a piezoelectric actuator 108 having a similar structure as the third embodiment of FIGS. 6 and 7. The piezoelectric actuator 108 is comprised of a piezoelectric device 47 which is polarized in any direction, and a pair of electrodes 48 and 49 of different lengths attached to either side of the piezoelectric device.

Figure 13:
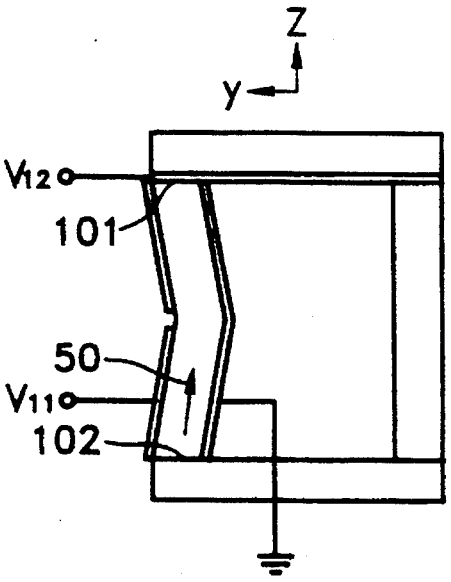

FIG. 13 illustrates an operation of the aforementioned piezoelectric actuator. The actuator deforms in a shear mode at its lower part due to the electrical field which is formed in a latitudinal direction 50 affected by voltage $V_{11}$, and deforms lengthwise at the upper part due to the electrical field which is formed longitudinally by voltage $V_{12}$. Therefore, the stresses at the contact portions between the piezoelectric devices and the upper and lower plates can be reduced to a minimum level.

So far, only those embodiments wherein just one wall of channel 7 is made of a piezoelectric actuator have been described. However, two or more channel walls can be made of a piezoelectric actuator.

Figure 14:
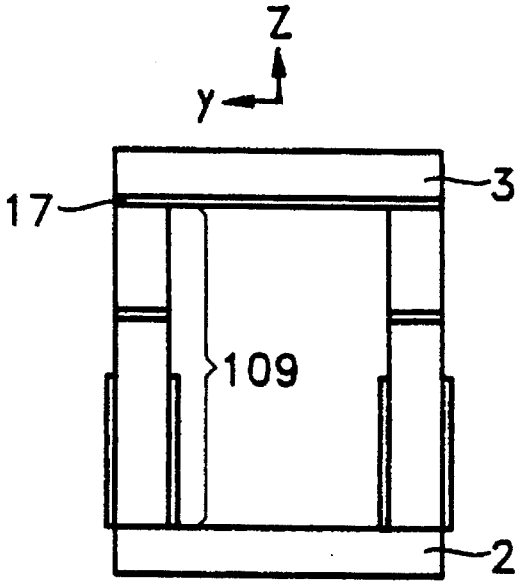
FIGS. 14 and 15 are a sectional view of the printing head according to yet a further embodiment of the present invention and a sectional view illustrating the operation thereof, respectively.

All embodiment thus constructed is illustrated in FIG. 14. Piezoelectric actuator 109 has the same structure as piezoelectric actuator 103 shown in FIG. 2, except that two actuators 103 are arranged in parallel so as to constitute a channel.

Figure 15:
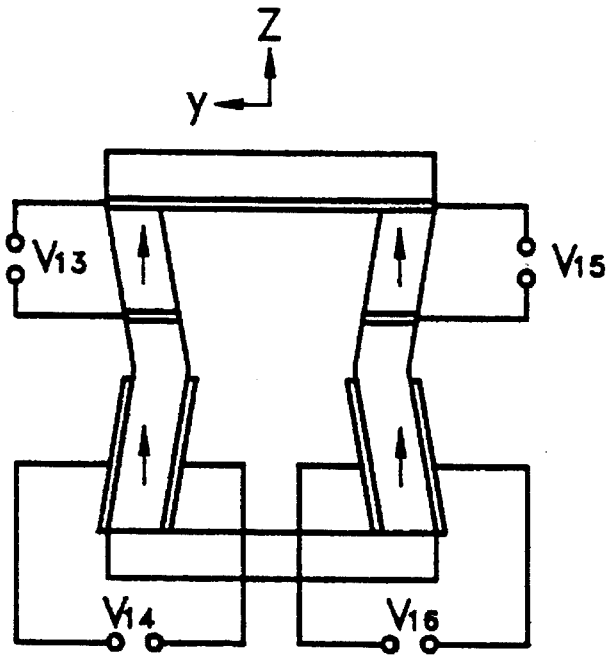

FIG. 15 illustrates an operation of the actuator shown in FIG. 14, in which the operating principle is same as in FIG. 3.

As described above, the printing head of the present invention comprises an actuator having the combination of a shear mode, a tension mode and a compression mode. Accordingly, the breakage of the contact portion between the piezoelectric devices and the upper and lower plates can be prevented by the stress concentration occurring on the contact plane, and, as a result, the life of the head can be extended further.

What is claimed is:

1. An inkjet printing head comprising;

a upper and a lower plate having an interval therebetween;

an electrode disposed adjacent said upper plate;

a wall connecting said upper plate with said lower plate;

a nozzle for ejecting ink droplets and arranged on said wall;

a side wall disposed between said upper and lower plates and a piezoelectric actuator disposed between said upper and lower plates having composite shear, tensile, and compressive modes, said actuator including a piezoelectric device polarized in a lengthwise direction, first and second electrodes having different lengths, the first and second electrodes being disposed on an upper or lower part of the piezoelectric device, and a third electrode on the upper or lower end of the piezoelectric device positioned a distance from the first and second electrodes.

2. An inkjet printing head as claimed in claim 1, wherein said third electrode forms a pair with each of said first and second electrodes.

3. An inkjet printing head comprising:

an upper and a lower plate having an interval therebetween;.

an electrode disposed adjacent said upper plate;

a wall connecting said upper plate with said lower plate;

a nozzle for ejecting ink droplets and arranged on said wall;

a side wall disposed between said upper and lower plates and a piezoelectric actuator disposed between said upper and lower plates having composite shear, tensile, and compressive modes, said actuator including an upper piezoelectric device polarized perpendicular to a lengthwise dimension, first and second electrodes disposed on either side of the upper piezoelectric device, a lower piezoelectric device polarized parallel to a lengthwise dimension, and third and fourth electrodes disposed on either side of the lower piezoelectric device, the upper and lower piezoelectric devices being combined with each other end to end and parallel to the lengthwise dimension.

4. An inkjet printing head as claimed in claim 3, wherein said first or second electrode of said piezoelectric device of said actuator is connected to said third or fourth electrode so as to form a common electrode.

5. An inkjet printing head comprising:

an upper and a lower plate having an interval therebetween;

an electrode disposed adjacent said upper plate;.

a wall connecting said upper plate with said lower plate;

a nozzle for ejecting ink droplets and arranged on said wall;

a side wall disposed between said upper and lower plates and a piezoelectric actuator disposed between said upper and lower plates having composite shear, tensile, and compressive modes, said actuator including a piezoelectric device polarized perpendicularly to said channel and at an arbitrary angle to a lengthwise direction, and first and second electrodes of different lengths disposed on respective first and second sides of said piezoelectric actuator.

6. An inkjet printing head as claimed in claim 5, wherein said actuator comprises a third electrode attached to one lateral part of said piezoelectric device thereby forms a pair with the longer electrode of said first and second electrodes.

7. An inkjet printing head comprising:

a nozzle;

a channel in fluid communication with said nozzle for supplying ink to said nozzle;

a channel electrode disposed within said channel;

a composite shear mode, tensile mode and compression mode piezoelectric actuator including at least first and second actuator electrodes, said piezoelectric actuator being disposed within said channel;

means for supplying a voltage to said at least first and second actuator electrodes to cause said piezoelectric actuator to move in a first direction; and means for supplying a voltage to said channel electrode to cause said piezoelectric actuator to move in a second direction perpendicular to the first direction to change pressure in said channel and force ink through said nozzle.

8. An inkjet printing head as claimed in claim 7 wherein said channel includes first and second opposed plates and first and second opposed side walls, the first and second plates and the first and second side walls having inner and outer surfaces.

9. An inkjet printing head as claimed in claim 8 wherein said piezoelectric actuator comprises at least part of said first side wall.

10. An inkjet printing head as claimed in claim 9 wherein the first and second actuator electrodes are disposed on the inner and outer surfaces of the piezoelectric actuator, respectively, and wherein the channel electrode is disposed on the inner surface of said first plate.

11. An inkjet printing head as claimed in claim 10 wherein said piezoelectric actuator includes a first piezoelectric device stacked on a second piezoelectric device with an bisecting electrode disposed between the first and second piezoelectric devices.

12. An inkjet printing head as claimed in claim 11 wherein the first and second piezoelectric devices are polarized in a direction of a lengthwise dimension.

13. An inkjet printing head as claimed in claim 12 wherein said means for supplying voltage to said channel electrode creates an electric field between said channel electrode and the bisecting electrode parallel to the direction of polarization of the first and second polarization devices thus causing said piezoelectric actuator to deform in a direction parallel to the direction of the electric field.

14. An inkjet printing head as claimed in claim 13 wherein said first or second actuator electrode is connected to said bisecting electrode.

15. An inkjet printing head as claimed in claim 10 wherein said piezoelectric actuator includes a piezoelectric device polarized in a directing of a lengthwise dimension and wherein said means for supplying voltage to said channel electrode creates an electric field between said channel electrode and the second actuator electrode such that at least a part of the piezoelectric device deforms in a direction parallel to the direction of polarization.

16. An inkjet printing head as claimed in claim 10 wherein said piezoelectric actuator includes a first piezoelectric device stacked on a second piezoelectric device.

17. An inkjet printing head as claimed in claim 16 wherein said first piezoelectric device is polarized in a direction of a lengthwise dimension and said second piezoelectric device is polarized in a direction perpendicular to the lengthwise dimension.

18. An inkjet printing head as claimed in claim 17 wherein said first piezoelectric device includes a first actuator electrode disposed on an outer surface and a second actuator electrode disposed on an inner surface and said second piezoelectric device includes a first actuator electrode disposed on an outer surface and a second actuator electrode disposed on an inner surface.

19. An inkjet printing head as claimed in claim 17 wherein said first piezoelectric device includes a first actuator electrode disposed on an outer surface and said second piezoelectric device includes a first actuator electrode disposed on an outer surface and further comprising a common actuator electrode disposed on the inner surface of the first and second piezoelectric devices.

* * * * *